US009616698B2

(12) United States Patent
Noguchi et al.

(10) Patent No.: US 9,616,698 B2
(45) Date of Patent: Apr. 11, 2017

(54) BOOKBINDING APPARATUS

(71) Applicants: Yoshihiro Noguchi, Tokyo (JP); Atsushi Hiroshima, Tokyo (JP); Masatoshi Nishikawa, Kyoto (JP)

(72) Inventors: Yoshihiro Noguchi, Tokyo (JP); Atsushi Hiroshima, Tokyo (JP); Masatoshi Nishikawa, Kyoto (JP)

(73) Assignee: RISO KAGAKU CORPORATION, Tokyo (JP)

( * ) Notice: Subject to any disclaimer, the term of this patent is extended or adjusted under 35 U.S.C. 154(b) by 354 days.

(21) Appl. No.: 14/264,667

(22) Filed: Apr. 29, 2014

(65) Prior Publication Data

US 2014/0321948 A1 Oct. 30, 2014

(30) Foreign Application Priority Data

Apr. 30, 2013 (JP) ..... 2013-095498

(51) Int. Cl.
*B42C 9/00* (2006.01)

(52) U.S. Cl.
CPC ..... *B42C 9/0025* (2013.01); *B42C 9/00* (2013.01); *B42C 9/0006* (2013.01); *B42C 9/0012* (2013.01); *B42C 9/0031* (2013.01)

(58) Field of Classification Search
CPC ..... B42C 9/00; B42C 9/0006; B42C 9/0012; B42C 9/0031
USPC ..... 412/37
See application file for complete search history.

(56) References Cited

U.S. PATENT DOCUMENTS

| | | | | |
|---|---|---|---|---|
| 8,366,369 | B2 * | 2/2013 | Toyoizumi | B42C 9/0025 412/37 |
| 2003/0185654 | A1 * | 10/2003 | Rathert | B42C 9/0018 412/37 |
| 2005/0238462 | A1 * | 10/2005 | Oota | B42C 9/0012 412/9 |
| 2009/0081002 | A1 * | 3/2009 | Kaneko | B42C 9/0018 412/37 |
| 2010/0260581 | A1 * | 10/2010 | Toyoizumi | B42C 9/0025 412/13 |

FOREIGN PATENT DOCUMENTS

| | | | | |
|---|---|---|---|---|
| DE | 3439984 | A1 * | 5/1986 | B42C 9/0012 |
| JP | 2007-062147 | A | 3/2007 | |
| JP | 2007062147 | A * | 3/2007 | |

* cited by examiner

*Primary Examiner* — Kyle Grabowski
(74) *Attorney, Agent, or Firm* — Manabu Kanesaka

(57) ABSTRACT

A bookbinding apparatus includes an application roller that applies glue onto a back edge face of a sheet bundle and a bookbinding control unit that positions the application roller onto the back edge face and causes the roller to execute glue application. The bookbinding apparatus applies a required amount of glue determined by a sheet bundle thickness by, after applying side glues to both side surfaces of the sheet bundle, bringing the application roller in contact with a first position within a central region on the back edge face and rotating the roller in a forward direction, bringing the application roller in contact with a second position between the first position and a right side of the sheet bundle, and rotating the roller in the forward direction. The glue is leveled to form a flat layer of adhesive with an adequate thickness.

2 Claims, 7 Drawing Sheets

GLUE APPLICATION POSITION FOR FIRST TIME

GLUE APPLICATION POSITION FOR SECOND TIME

CONDITION OF GLUE APPLIED

BOOKBINDING APPARATUS

TECHNICAL FIELD

The present invention relates to a bookbinding apparatus that performs bookbinding by putting plural text sheets together into a bundle of text sheets and applying an adhesive agent to the back edge face of the sheet bundle. In particular, the present invention relates to a bookbinding apparatus that is capable of applying an adhesive agent with an adequate thickness evenly onto the back edge face of a bundle of text sheets to reduce the likelihood of occurrence of troubles such as spine split meaning that a bundle of text sheets is split intermediately along its thickness direction and loose sheets meaning that some of text sheets are loosen off from a bundle of text sheets. The invention can be used for, e.g., inter alia, adhesive binding that binds text sheets by applying an adhesive agent onto the back edge face thereof and soft cover binding that performs binding by lapping a bundle of text sheets, after applying an adhesive agent onto its back edge face, with a cover sheet.

BACKGROUND ART

In Japanese Published Unexamined Patent Application No. 2007-62147, an invention relating to a glue application apparatus that applies glue to the back edge face of a booklet structure made up of gathered sheets is disclosed. As described in that document, this glue application apparatus includes a container 6 storing glue for binding, a drum 7 that is installed inside the container 6 and rotates with its surface covered by glue, and clampers 4 that nip a booklet structure between them and can reciprocate and pass above the drum 7. According to this apparatus, as the clampers 4 that clamp a booklet structure pass above the rotating drum 7, the back edge face of the booklet structure is brought into contact with the drum 7; as a result, glue can be applied to the back edge face of the booklet structure nipped between the clampers 4. In this apparatus, a motor 8 that drives and rotates the drum 7 and a motor 9 that drives and moves the clampers 4 are provided separately. It is set forth that, by arbitrarily setting the rotating speeds of the respective motors 8 and 9, it is possible to arbitrarily change a relative speed between the circumferential speed of the drum 7 and the passage speed of the clampers 4 and properly perform glue application to the back edge face of the booklet structure. In the foregoing description, the reference numerals of the respective components are as found in the patent document listed below.

Japanese Published Unexamined Patent Application No. 2007-62147.

According to the present invention, titled "glue application apparatus", described in Japanese Published Unexamined Patent Application No. 2007-62147, applying a glue onto the back edge face of a booklet structure is performed by making the booklet structure pass above the drum once, while bringing its back edge face into contact with the rotating drum. Explaining this with reference to FIGS. 10A to 10C, when the drum 100 is made to rotate in a direction indicated by arrow A in FIG. 10A, a single action of moving the booklet structure 101 to the right hand in the figure is performed, while bringing the back edge face 102 of the booklet structure 101 into contact with the top of the drum 100, thus applying the glue G onto the back edge face 102. However, according to such a glue application method, in practice, there is a problem in which it may sometimes be impossible to apply the glue G with a proper thickness evenly onto the back edge face 102 of the booklet structure 101.

In applying the glue G using the drum 100 in this way, the quantity of the glue G to be applied onto the back edge face 102 of the booklet structure 101 is generally proportional to the thickness of the booklet structure 101. Also, the quantity of the glue G that is applied onto the back edge face 102 of the booklet structure 101 is determined by an amount of rotation (rotation angle) of the drum 100. Hence, if the thickness of the booklet structure 101 is large, the amount of rotation of the drum 100 must be increased accordingly to apply a required quantity of glue G onto the back edge face 102. In some cases, however, it is found to make it impossible to apply the glue G in more than a given quantity onto the back edge face 102, because the glue G drawn from the container and adhered to the drum 100 is fed to between the back edge face 102 and the drum 100 which are in contact with each other, but some of the glue G is blocked by the back edge face 102 and the drum 100 and pushed back. Even though it is attempted to feed a required quantity of the glue G, some of the fed glue G slips down along the circumferential surface of the drum 100 to upstream in the rotation direction, as indicated by arrow B in FIG. 10A.

Even if a lot of glue G has been made to adhere to the back edge face 102 in this way, a uniform distribution of the glue G over the back edge face 102 cannot be attained because of a single action of glue G application. Also, because a quantity of glue that can be kept adhered to the back edge face 102 against gravity is limited in view of viscosity of the glue G that is generally used, it occurs that a portion of the glue G adhered to the back edge face 102, especially a heavily adhered glue portion drops by the force of the gravity and the quantity of the glue G remaining on the back edge face 102 decreases, as illustrated in FIG. 10B. Therefore, in some cases, it is found that the quantity of the glue G that can be applied onto the back edge face 102 is not necessarily sufficient for good binding.

When the booklet structure 101 moves from left to right in FIG. 10, while contacting the drum 100, the glue G is applied to its back edge face 102. In this glue application method, it tends to be difficult to attain uniform distribution over the back edge face 102, as noted previously. That is, as illustrated in FIG. 10C, in an end position of the edge face (left in the figure) where glue G application begins, the quantity of the glue G that adheres to the back edge face 102 is less, as noted previously, whereas, in an end portion of the edge face (right in the figure) where the back edge face 102 of the booklet structure 101 is away from the drum 100, the fed glue G is liable to remain on the back edge face 102, thus resulting in a larger quantity of the glue G adhered to the face. As a result, it is found that some of the glue G drops, as noted previously, which makes the quantity of the glue G adhered to the back edge face 102 insufficient, and the condition of adhesion of the glue G over the back edge face 102 becomes uneven.

Therefore, in bookbinding through the use of the foregoing glue application apparatus of related art, it is difficult to apply a required quantity of an adhesive agent evenly over the back edge face of a bundle of text sheets into which plural text sheets have been gathered. In consequence, it has been impossible to avoid the occurrence of troubles such as spine split meaning that a finished book (booklet) is split intermediately along its thickness direction and loose sheets meaning that some of text sheets are loosen off from a bundle of text sheets.

The prevent invention has been made in the light of the foregoing problem and is intended to provide a bookbinding apparatus that is capable of applying an adhesive agent with a suitable thickness evenly over the back edge face of a bundle of text sheets, thus reducing the likelihood of occurrence of troubles such as spine split and loose sheets in a finished book.

SUMMARY OF INVENTION

According to a first aspect of the present invention, a bookbinding apparatus includes a holding element that holds a bundle of text sheets into which plural text sheets have been gathered with a back edge face of the bundle down by nipping at its both side surfaces; an application roller that rotates, while being partially immersed in an adhesive agent, on a rotary shaft which is parallel with a top-bottom direction of the bundle of text sheets held by the holding elements; a motive mechanism including a motive element for making a relative motion between the holding element and the application roller; and a control unit that controls the holding element, the application roller, and the motive mechanism in such a way as to bring the application roller in contact with the back edge face of the bundle in plural positions, respectively, which have been set on the back edge face along a thickness direction perpendicular to the top-bottom direction of the bundle of text sheets, rotate the application roller in each of the positions, and apply the adhesive agent onto the back edge face of the bundle.

According to a second aspect of the present invention, in the bookbinding apparatus according to the first aspect, the control unit controls the application roller and the motive mechanism in such a way as to bring the application roller in contact with the back edge face of the bundle in a first position within a given central region set on the back edge face with respect to the thickness direction, rotate the application roller in a given first direction, and apply the adhesive agent onto the back edge face of the bundle; and to bring the application roller in contact with the back edge face of the bundle in a second position set on the back edge face with respect to the thickness direction between the first position and one side of the bundle of text sheets being forward in a moving direction of the application roller in the first position, rotate the application roller in the first direction, and apply the adhesive agent onto the back edge face of the bundle.

According to a third aspect of the present invention, in the bookbinding apparatus according to the first or second aspect, the control unit controls the application roller and the motive mechanism in such a way to execute application of the adhesive agent onto the back edge face of the bundle after applying the adhesive agent onto a portion of the both side surfaces along the back edge face respectively with the application roller.

According to the bookbinding apparatus in the first aspect, the holing element for a bundle of text sheets, the application roller, and the motive mechanism for making a relative motion between the holding element and the application roller is integrally controlled by the control unit as will be described below. That is, the holding unit holds a bundle of text sheets into which plural text sheets have been gathered with the back edge face of the bundle down by nipping at its both side surfaces. The application roller rotates while being immersed in an adhesive agent and draws the adhesive agent by having the adhesive agent adhered to its circumferential surface. The motive mechanism makes a relative motion between the holding element and the application roller to bring the application roller in contact with one position on the back edge face of the bundle of text sheets and apply the adhesive agent onto the back edge face. The motive mechanism further makes a relative motion between the holding element and the application roller to move a point in which the application roller contacts the back edge face from the one position in a thickness direction to another position set on the back edge face and apply the adhesive agent onto the back edge face of the bundle by rotation of the application roller in that position.

Application of the adhesive agent onto the back edge face is executed in plural positions on the back edge face of the bundle of text sheets in this way. In subsequent bonding, convex portions of the adhesive agent applied onto the back edge face in each position are leveled and a flat layer of the adhesive agent with an adequate thickness can be formed on the back edge face of the bundle of text sheets. As the result, troubles such as spine split and loose sheets are less liable to occur in a finished book.

According to the bookbinding apparatus in the second aspect, the bookbinding apparatus brings the application roller in contact with the back edge face of the bundle in a first position within the central region on the back edge face of the bundle of text sheets, rotates the application roller in a given first direction, and applies the adhesive agent onto the back edge face of the bundle (a first step of application). Then, the bookbinding apparatus moves the application roller to a second position at a certain interval from the first position with respect to a moving direction of the application roller in the first position, rotates the application roller in this position in the same direction as it rotates in the first position, and applies the adhesive agent onto the back edge face of the bundle (a second step of application). According to the first step of application, the adhesive agent is applied onto the back edge face before the first position which is in the substantially center of the back edge face in the rotation direction of the application roller. In the second step of application, the adhesive agent is applied onto the back edge face before the second position, that is, toward the first position, in the rotation direction of the application roller, the second position being nearer to one side of the bundle of text sheets than the first position.

As the result of applying the adhesive agent by rotating the application roller in the same direction in two different positions, namely the first position in the substantially center of the back edge face and the second position to which the roller moves from the first position along its rotation direction, such a disadvantage is avoided that forms of a non-uniform layer in which only a particular portion becomes thicker, as the portions of the adhesive agent made to adhered to the face in each step of application overlap and adhere to the face in one position on the back edge face. Therefore, it is possible to avoid such troubles that some of the adhesive agent drops from a thick portion in a particular position and the amount of the adhesive agent becomes insufficient and that an insufficient bonding portion is produced by an uneven application condition. If the adhesive agent adhered to the back edge face in each step of application makes a convex portion respectively in each position, an exactly flat layer as a whole is not formed. By deploying the first and second positions suitably or setting the interval between the convex portions of the adhesive agent, which is determined by deploying both the positions, to a value appropriate for the thickness of the bundle of text sheets, the convex portions of the adhesive agent adhered to the back edge face are leveled in binding without shortage of the adhesive agent even in a recess between two convex portions of the adhesive agent, and it is possible to form a flat layer of the adhesive agent with an adequate thickness. Thus, it is possible to reduce the likelihood of occurrence of troubles such as spine split and loose sheets in a finished book.

According to the bookbinding apparatus in the third aspect, the adhesive agent as back glue can be applied onto the back edge face of the bundle of text sheets after the adhesive agent as side glue is positively applied onto a portion of both side surfaces of the bundle of text sheets, this portion being the edge portion of each side surface adjacent to both edges of the back edge face in the thickness direction. In reverse order, if the adhesive agent is applied to the side surfaces of the bundle of text sheets after the application of the adhesive agent onto the back edge face of the bundle of text sheets, a case is supportable where the adhesive agent adhered to the back edge face may be peeled off depending on which direction in which the application roller rotates. As a result, it may be impossible to apply the adhesive agent to the side surfaces of the bundle of text sheets, when doing so, because there is no adhesive agent adhering to the circumferential surface of the application roller. According to this aspect of the present invention, free from such disadvantage, it is possible to positively apply the adhesive agent required to perform soft cover binding that laps the bundle of text sheets with a cover sheet, bonding the cover sheet to the back edge face initially.

DESCRIPTION OF EMBODIMENTS

An overall structure of a bookbinding system 1 of an embodiment is described with reference to FIGS. 1 through 3.

Figure 1:
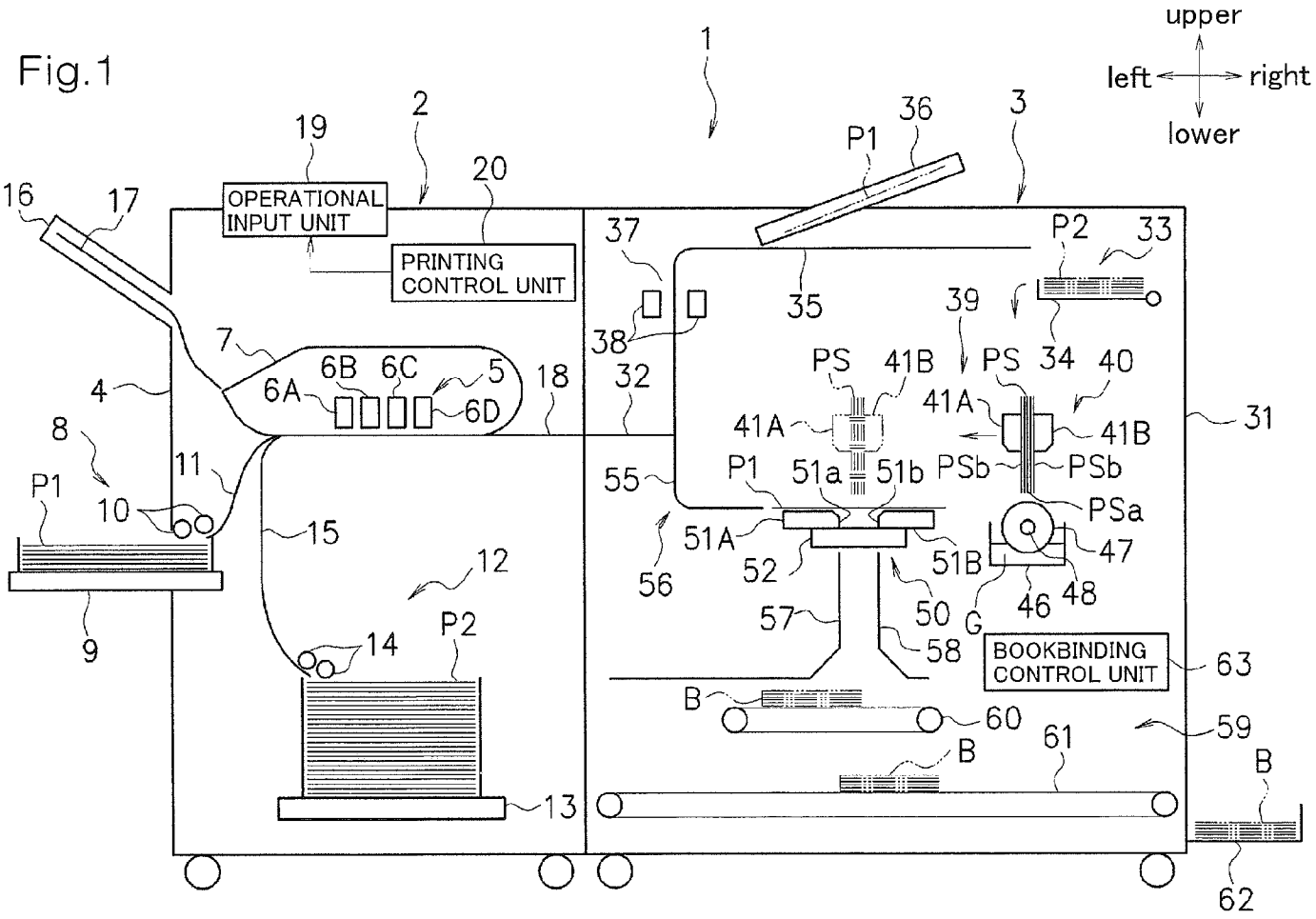
FIG. 1 is an overview structural diagram of a bookbinding system pertinent to an embodiment of the present invention.

The bookbinding system 1 of the present embodiment includes a printing apparatus 2 and a bookbinding apparatus 3, as depicted in FIG. 1, and is a system for creating plural sheets of prints by printing on the sheets with the printing apparatus 2 and combining the plural sheets of prints into a booklet (book) with the bookbinding apparatus 3. The present invention relates to, particularly, components (such as a bonding unit 39 and an adhesive application unit 40 which will be described later) of the bookbinding apparatus 3 for applying an adhesive agent onto the back edge face of a bundle of text sheets into which plural text sheets have been gathered.

Figure 2:
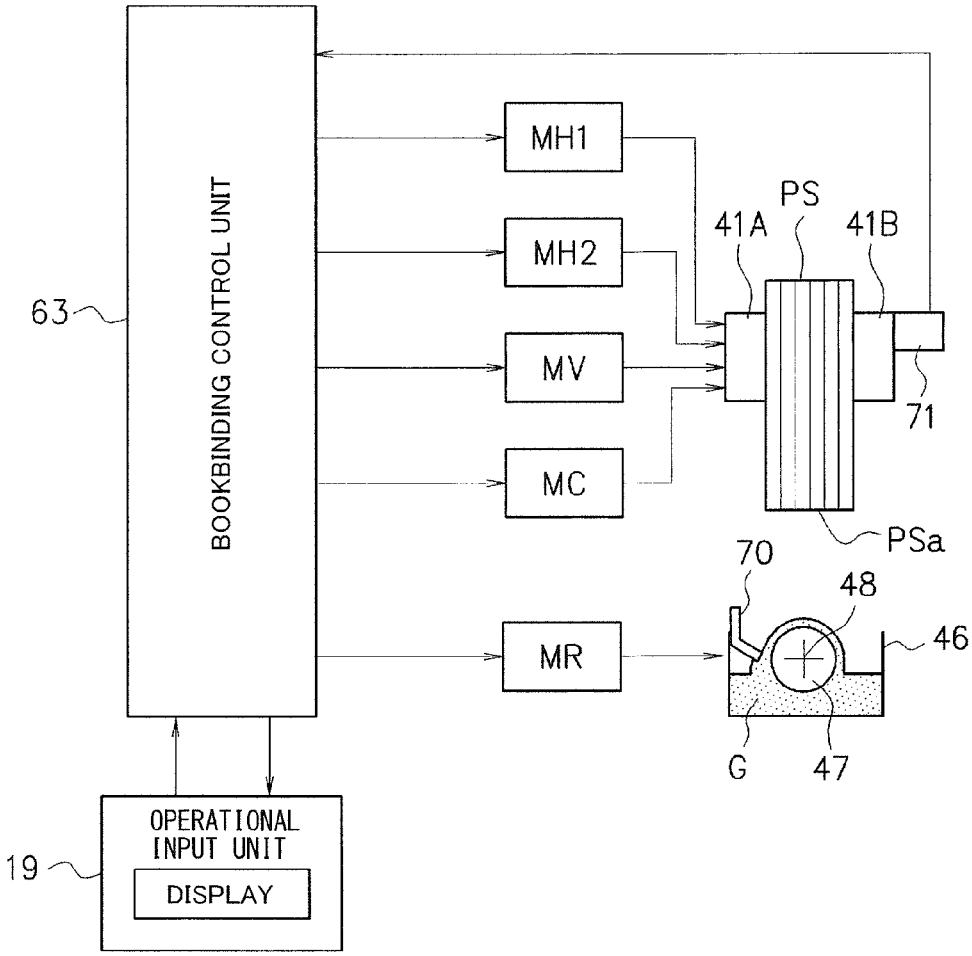
FIG. 2 is a functional block diagram of a bookbinding apparatus pertinent to an embodiment of the present invention.
Figure 3:
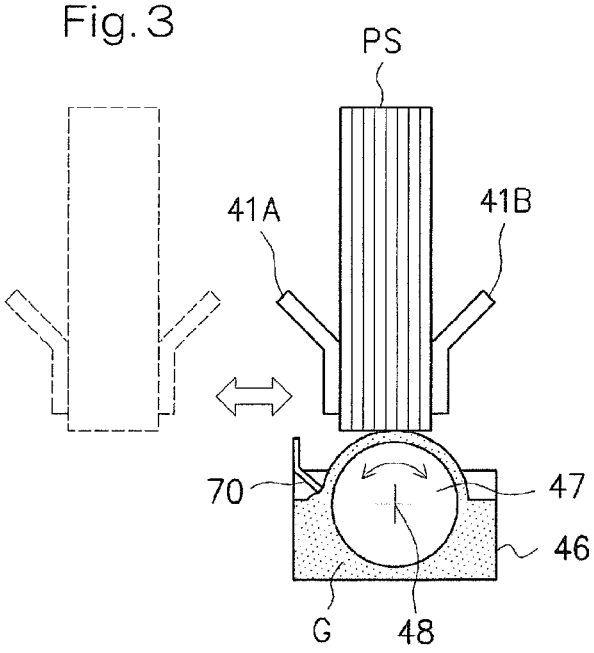
FIG. 3 is an enlarged view of an adhesive application unit in the bookbinding apparatus pertinent to an embodiment of the present invention and represents an action of applying an adhesive agent onto the back edge face and its periphery of a bundle of text sheets with an application roller.

In the following description, FIG. 1 is mainly referred to; besides, FIG. 2 and FIG. 3 are also referred to, as appropriate. In descriptions with reference to FIGS. 1 and 2, words "upper", "lower", "left", and "right" are used to indicate a direction or position. These words correspond to "upper", "lower", "left", and "right" when a user views the bookbinding system 1 as depicted, as indicated by legend arrows shown in FIG. 1. When viewing FIG. 1, the front of the drawing is referred to as "fore (forward)" or "front side" and the back of the drawing is referred to as "back (backward)" or "rear side".

The printing apparatus 2 performs printing on a cover sheet P1 and a text sheet (also referred to as a book body sheet) P2 to be bound into a booklet by the bookbinding apparatus 3.

As depicted in FIG. 1, the printing apparatus 2 has a printing apparatus housing 4 (hereinafter referred to as simply a housing 4). Inside the housing 4, a printing unit 5 is provided. The printing unit 5 is a device that performs printing on a cover sheet P1 and a text sheet P2. The printing unit 5 includes four line-type ink jet heads 6*a* to 6D that jet cyan (C), magenta (M), yellow (Y), and black (B) colored inks respectively. Inside the housing 4, a loop-like printing transport path 7 for transporting a cover sheet P1 and a text sheet P2 is provided to surround the printing unit 5. Although not depicted, plural carrying rollers which transport a cover sheet P1 and a text sheet P2 are disposed in place.

The housing 4 is provided in its left side with a cover sheet feeder 8 to feed a cover sheet P1 to the printing unit 5 (printing transport path 7). The cover sheet feeder 8 includes a paper tray 9 in which plural cover sheets P1 are stacked, paper feed rollers 10 to deliver a cover sheet P1 stacked in the paper tray 9 toward the printing unit 5, a paper feed path 11 provided between the paper tray 9 and the printing transport path 7, and plural rollers (not depicted) disposed along the paper feed path 11, and can transport a cover sheet P1 to the printing unit 5.

Beneath the printing unit 5 inside the housing 4, a text sheet feeder 12 is provided to feed a text sheet P2 to the printing unit 5 (printing transport path 7). The text sheet feeder 12 includes a paper tray 13 in which plural text sheets P2 are stacked, paper feed rollers 14 to deliver a text sheet P2 of paper stacked in the paper tray 13, a paper feed path 15 provided between the paper tray 13 and the printing transport path 7, and plural rollers (not depicted) disposed along the paper feed path 15, and can transport a text sheet P2 to the printing unit 5.

A switchback 16 to temporarily accommodate a cover sheet P1 and a text sheet P2 is provided at upper left of the printing transport path 7. A switchback path 17 is provided from a left section in the housing 4 to the switchback 16. The switchback path 17 is provided for reversing a cover sheet P1 and a text sheet P2 and feeding them again to the printing unit 5, when both-side printing is performed. A base end (right end) of the switchback path 17 is provided with a flipper (not depicted) that can be switched open/closed such that connection to the printing transport path 7 can be allowed or blocked.

In a right section inside the housing 4, a connecting transport path 18 is provided to transport a cover sheet P1 and a text sheet P2 delivered from the printing transport path 7 to the bookbinding apparatus 3 (rightward). A base end (left end) of the connecting transport path 18 is provided with a flipper (not depicted) that can be switched open/closed such that connection to the printing transport path 7 can be allowed or blocked.

An operational input unit 19 is provided at the top of the housing 4. The operational input unit 19 accepts user input. The operational input unit 19 includes operating buttons, a touch panel, etc. for user input for various operations and, in addition, it is provided with a display so that input entered by a user, matters necessary for control, matters (warning, cautions, etc.) that should be notified to the user from the apparatus, and so on can be displayed.

The printing apparatus 2 is equipped with a printing control unit 20. The printing control unit 20 includes a CPU, RAM, ROM, etc. and is an element that integrally controls the operations of the respective components of the printing apparatus 2 and causes the apparatus to perform printing.

The bookbinding apparatus 3 carries out a predefined bookbinding process on a cover sheet P1 and a text sheet P2 and creates a booklet and includes components, as mentioned previously, for applying an adhesive agent onto the back edge face of a bundle of text sheets.

The bookbinding apparatus 3 has a bookbinding apparatus housing 31 (hereinafter referred to as simply a housing 31). Inside the housing 31, a carry-in transport path 32 is provided to transport a cover sheet P1 and a text sheet P2 that have been printed, delivered from the connecting transport path 18 of the printing apparatus 2, rightward. A base end (left end) of the carry-in transport path 32 is connected to a forward end (right end) of the connecting transport path 18. Although not depicted, plural rollers to transport a cover sheet P1 and a text sheet P2 are disposed along the carry-in transport path 32.

In an upper right section inside the housing 31, an aligner 33 is provided to align printed text sheets P2 and gather them into a bundle PS of text sheets (also referred to as simply a sheet bundle). The aligner 33 includes an alignment tray 34 in which plural text sheets P2 are stacked. The alignment tray 34 is adapted such that it can deliver a sheet bundle PS staked therein downward, for example, by rotating about a horizontal spindle. In an upper section in the housing 31, an upper bookbinding transport path 35 is provided, inter alia, to transport a cover sheet P1 and a text sheet P2 that haven been printed, delivered from the carry-in transport path 32, to the aligner 33. A base end (left end) of the upper bookbinding transport path 35 is provided with a flipper (not depicted) that can be switched open/closed such that connection to a forward end (right end) of the carry-in transport path 32 can be allowed or blocked.

In an upper center section in the housing 31, a stock tray 36 that keeps a printed cover sheet P1 standing still for a while is provided. Connection of a base end (left end) of the stock tray 36 to the upper bookbinding transport path 35 can be allowed or blocked by a flipper (not depicted). Also, rollers (not depicted) are provided in place in the stock tray 36 to deliver a printed cover sheet P1 from the stock tray 36 to the upper bookbinding transport path 35. Plural rollers (not depicted) which transport a cover sheet P1 and a text sheet P2 are disposed in positions along the upper bookbinding transport path 35. Among them, plural rollers disposed to the left of the stock tray 36 along the upper bookbinding transport path 35 are adapted such that they can invert the transport direction of a printed cover sheet P1 and transport it.

A cutting unit 37 is provided to the left of the stock tray 36 inside the housing 31. The cutting unit 37 includes cutters 38 that cut a cover sheet P1, while nipping it from the both sides of the upper bookbinding transport path 35, and can cut a printed cover sheet P1 to dimensions that accommodate the thickness of a sheet bundle PS.

A bonding unit 39 is provided in a central section inside the housing 31. This bonding unit 39 is a device that executes soft cover binding (which is also called "case binding"); it receives a sheet bundle PS delivered from the alignment tray 34 of the aligner 33 and applies a hot-melt adhesive agent (hereinafter referred to as simply an adhesive agent or glue) onto the back edge face PSa of the sheet bundle PS and the edge portions of its side surfaces PSb adjacent to the back edge face PSa; it then presses the back edge face PSa of the sheet bundle PS against a central part of a printed cover sheet P1 delivered from the cutting unit 37 to bond the back edge face PSa to the central part of the sheet P1; and it laps the sheet bundle PS with the cover sheet P1 in a booklet form. As described in the beginning of this section, this bonding unit 39 includes an element for applying an adhesive agent to the back edge face of a bundle of text sheets into which plural text sheets have been gathered and makes up a principal part of the present invention.

As depicted in FIG. 1, the bonding unit 39 is equipped with an adhesive application unit 40 which is the element that applies an adhesive agent. The adhesive application unit 40 is a device that applies an adhesive agent G onto the back edge face PSa of a sheet bundle PS and the edge portions of its side surfaces PSb adjacent to the back edge face PSa.

As depicted in FIGS. 1 through 3, the adhesive application unit 40 includes a pair of clampers 41A, 41B that can be opened and closed, as a holding element for holding a sheet bundle PS made up of plural text sheets gathered, transporting the sheet bundle PS to a desired position, and positioning it. The clampers 41A, 41B receive a sheet bundle PS made up of plural text sheets gathered from the aligner 33 and can hold it with its back edge face down by nipping at its front and back surfaces or a pair of side surfaces. Although the shapes of the clampers 41A, 41B appear to be different from each other as depicted in each of FIGS. 1 through 3, the clampers may have any of these shapes. Their shapes depicted in these figures represent a variation applicable in the present embodiment. The pair of clampers 41A, 41B is movable, as will be described later, and can position the back edge face PSa of a sheet bundle PS held by it onto a glue application roller 47 arbitrarily, which will be described in the following context.

As depicted in FIG. 1, the adhesive application unit 40 is equipped with an adhesive container 46 that contains a hot-melt adhesive agent G at lower left of the alignment tray 34. As can be seen in FIGS. 1 through 3, the adhesive container 46 is a cuboid container that is long in a front-back direction (a direction perpendicular to the front of the drawing); its top is open and the application roller 47 is placed inside it along its longitudinal direction. The application roller 47 is an application element for applying a hot-melt adhesive agent G onto the back edge face PSa of a sheet bundle PS and a part of its side surfaces PSb.

The application roller 47 is a long cylindrical member that extends in the front-back direction (the direction perpendicular to the front of the drawing in FIGS. 1 to 3) and is supported rotatably on a rotary spindle 48 inside the adhesive container 46. This rotary spindle 48 is parallel with a top-bottom direction (the direction perpendicular to the front of the drawing in FIGS. 1 to 3) of a bundle of text sheets, mentioned previously, held by the clampers 41A, 41B, and substantially parallel with the surface of the hot-melt adhesive agent G contained in the adhesive container 46.

As depicted in FIG. 2, an application roller driving motor MR is connected to the rotary spindle 48 and can turn the application roller 47, which is partially immersed in the hot-melt adhesive agent G contained in the adhesive container 46, in a desired direction. Although not depicted, a great number of circumferential grooves are formed at certain intervals in an axial direction of the rotary spindle 48 on the circumferential surface, which is the application surface, of the application roller 47. This provides the roller structure to which the hot-melt adhesive agent G can easily adhere. Owing to this, with the rotation of the application roller 47 inside the adhesive container 46, the hot-melt adhesive agent G adheres to the circumferential grooves and moves with the application roller 47. It is thus possible to draw the agent above the surface.

Therefore, by bringing the back edge face PSa of a sheet bundle PS into contact with a part of the circumferential surface of the application roller 47 to which the hot-melt adhesive agent G is adhered, it is possible to apply the hot-melt adhesive agent G to the back edge face PSa of the sheet bundle PS. The length of the application surface of the application roller 47 with respect to its longitudinal direction (in the axial direction of the rotary spindle 48) is set larger than the longitudinal dimension of a sheet bundle PS having the largest size among sheet bundles that are handled by the present apparatus. Owing to this, even if any kind of text sheets (book body sheets) P2 are used, it is possible to perform the operation of applying the adhesive agent G onto the back edge face PSa of a sheet bundle PS over the entire length in its longitudinal direction.

As can be seen in FIGS. 2 and 3, a glue paring blade 70 is provided in the opening of the adhesive container 46. The glue paring blade 70 is a plate-like member. The glue paring blade 70 is installed to one edge (left in the drawing) of a pair of longitudinal edges parallel with the rotary spindle 48 of the application roller 47, the edges surrounding the opening of the adhesive container 46. This glue paring blade 70 is placed to extend obliquely downward inside the adhesive container 46. There is provided a gap with a given dimension between the circumferential surface of the application roller 47 in a position under and near the surface of the adhesive agent G present in the adhesive container 46 and the tip of the glue paring blade 70.

Therefore, when the application roller 47 rotates in a direction (clockwise in the drawing, referred to as a forward direction) such that a part of the application roller 47 above the surface of the adhesive agent G goes way from the glue paring blade 70, the glue paring blade 70 scraps off some of the adhesive agent G drawn and adhered to the circumferential surface of the rotating application roller 47, and a layer of the adhesive agent G with a given thickness which corresponds to the gap between the glue paring blade 70 and the application roller 47 can be formed on the circumferential surface of the application roller 47.

The application roller 47 can also rotate in an opposite direction (counterclockwise in the drawing) which is opposite to the forward direction; in this case, however, because the glue paring blade 70 does not function, it is not necessarily ensured that the thickness of a layer of glue drawn and adhered to the circumferential surface of the application roller 47 is constant.

The adhesive application unit 40 depicted in FIG. 1 includes a clamper opening/closing motor MC that makes the clampers 41A, 41B open and close and a thickness sensor 71 that detects a distance between the pair of clampers 41A, 41B nipping a sheet bundle PS therebetween and outputs a thickness signal, as depicted in FIG. 2. In addition, the adhesive application unit 40 includes a clamper lateral motion motor MH1 as a motive element that moves the clampers 41A, 41B in a horizontal direction, a clamper back-forth motion motor MH2 as a motive element that moves the clampers 41A, 41B in a back and forth direction, and a clamper vertical motion motor MV as a motive element that moves the clampers 41A, 41B in a vertical direction. Although not depicted in FIG. 2, the adhesive application unit 40 may further include a clamper swaying motor that sways the clampers 41A, 41B in a horizontal direction, as necessary.

As can be seen in FIG. 2, the clamper opening/closing motor MC and the application roller driving motor MR are connected to a bookbinding control unit 63 and controlled by the bookbinding control unit 63. Three motors which are the motive elements that move the clampers 41A, 41B to position a sheet bundle PS onto the application roller 47, namely, the clamper lateral motion motor MH1, the clamper back-forth motion motor MH2, and the clamper vertical motion motor MV are also connected to the bookbinding control unit 63 and controlled by the bookbinding control unit 63. The thickness sensor 71 is also connected to the bookbinding control unit 63, so that the bookbinding control unit 63 can detect the thickness of a bundle of text sheets being held by the clampers 41A, 41B by receiving a thickness signal sent from the thickness sensor 71 and use it in controlling the respective motors.

Once a sheet bundle PS from the alignment tray 34 of the aligner 33 has entered between the clampers 41A, 41B set in a predetermined receiving position, the bookbinding control unit 63 controls the clamper opening/closing motor MC at appropriate timing to close the clampers 41A, 41B so that the sheet bundle PS is held by the clampers 41A, 41B with its back edge face down. The bookbinding control unit 63 also detects the thickness of the sheet bundle PS held by the clampers 41A, 41B according to a thickness signal sent from the thickness sensor 71. Taking this thickness into account, the bookbinding control unit 63 sets an amount of rotation (rotation angle) of the application roller driving motor MR to an appropriate value for adhesive application. This is because the required amount of the adhesive agent G to be applied onto the back edge face of a bundle of text sheets increases in proportion to the thickness of the bundle of text sheets, and the amount of the adhesive agent G that can be supplied onto the back edge face by the application roller 47 is proportional to the amount of rotation of the application roller 47. Furthermore, the bookbinding control unit 63 positions the back edge face PSa of the sheet bundle PS held by the clampers 41A, 41B onto the circumferential surface of the application roller 47 by controlling the clamper lateral motion motor MH1, the clamper back-forth motion motor MH2, and the clamper vertical motion motor MV which are the motive elements for moving the clampers 41A, 41B. What position on the back edge face PSa of the sheet bundle PS should be brought into contact with the application roller 47 for adhesive application is determined by the bookbinding control unit 63 based on the thickness of the bundle of text sheets detected by the thickness sensor 71, data given beforehand, and variable settings or the like. This control will be described in detail later.

As depicted in FIG. 1, the bonding unit 39 is equipped with a folding unit 50. The folding unit 50 is a device that executes a process in which a sheet bundle PS, after the hot-melt adhesive agent G has been applied onto its back edge face by the adhesive application unit 40 mentioned previously, is bonded to a cover sheet PS and the cover sheet P1 is folded to lap the sheet bundle PS.

The folding unit 50 is provided to the left of the adhesive container 46. The folding unit 50 includes a pair of back folding plates 51A, 51B and an abutment plate 52 provided under the back folding plates 51A, 51B. The back folding plates 51A, 51B are movable in a horizontal direction on the abutment plate 52 so that they will come close to and go away from each other. The back folding plates 51A, 51B have pressing surfaces 51*a*, 51*b* which face each other. The pressing surfaces 51*a*, 51*b* are vertical planes that are substantially perpendicular to the upper surface of the abutment plate 52 which is substantially horizontal. The abutment plate 52 is movable in a horizontal direction. After the hot-melt adhesive agent has been applied onto the back edge face PSa of a sheet bundle PS, the back edge face PSa is placed abutting against the abutment plate 52 with a cover sheet P1 inserted between the sheet bundle and the plate. In this state, the pressing surfaces 51*a*, 51*b* of the back folding plates 51A, 51B press the sheet bundle PS with the cover sheet P1 inserted between the sheet bundle and the plates from right and left sides; thereby, the cover sheet P1 is folded.

Although not depicted, the folding unit 50 is equipped with a back folding plate moving motor that moves the back folding plates 51A, 51B in a horizontal direction and an abutment plate moving motor that moves the abutment plate 52 in a horizontal direction.

Inside the housing 31 and under the upper bookbinding transport path 35, there is provided a lower bookbinding transport path 55 to transport a printed cover sheet P1 delivered from the upper bookbinding transport path 35 to the folding unit 50. Connection of a base end (left end) of the lower bookbinding transport path 55 to a base end (left end) of the upper bookbinding transport path 35 can be allowed or blocked by a flipper (not depicted). Plural rollers (not depicted) which transport a cover sheet P1 to the folding unit 50 are disposed in positions along the lower bookbinding transport path 55.

A conveyance unit 56 is configured inside the housing 31. The conveyance unit 56 includes the carry-in transport path 32, the upper bookbinding transport path 35, the lower bookbinding transport path 55, rollers disposed along these paths, rollers to deliver a cover sheet P1 from the stock tray 36 to the upper bookbinding transport path 35, and motors, not depicted, to move the rollers, among others.

Inside the housing 31 and under the folding unit 50, there are provided guide members 57, 58 that guide a finished booklet B dropping from the folding unit 50 to a predetermined lower position.

Under the guide members 57, 58, there is provided an ejection unit 59 to eject a booklet B dropped from the folding unit 50 outside the housing 31. The ejection unit 59 includes a carrying conveyor 60 that catches a booklet B dropped from the folding unit 50, carries the booklet B leftward, and makes it drop downward. The ejection unit 59 also includes an ejection conveyor 61 provided under the carrying conveyor 60. The ejection conveyor 61 is a device that catches a booklet B dropped from the carrying conveyor 60, carries the booklet B rightward, and discharges it outside the housing 31. Below the ejection conveyor 61, there is a receiving tray 62 that receives the booklet B discharged from the ejection conveyor 61.

The bookbinding apparatus 3 is equipped with the bookbinding control unit 63 as a control element that controls the operations of the respective components of the bookbinding apparatus 3, which have been described hereinbefore, and causes the apparatus to perform a bookbinding process. That is, the bookbinding control unit 63 is an element that controls the application operation of applying an adhesive agent G onto the back edge face of a sheet bundle by controlling the clampers 41A, 41B to hold a sheet bundle PS as described previously, an amount of rotation of the application roller 47 for applying the adhesive agent G, and a positional relation between the back edge face PSa of the sheet bundle PS and the application roller 47; and integrally controls an overall bookbinding process by the present apparatus including the above. The bookbinding control unit 63 is constituted including a CPU, RAM, ROM, etc.

Next, referring to FIGS. 4 through 7, descriptions are provided for a control method for applying an adhesive agent G onto the back edge face PSa of a sheet bundle PS with the application roller 47 regarding the bookbinding apparatus 3 of the bookbinding system 1 described hereinbefore.

The bookbinding apparatus 3 of the present embodiment performs bookbinding by lapping a sheet bundle PS to which an adhesive agent G has been applied with a cover sheet (soft cover binding). To lap a sheet bundle PS with a cover sheet and integrate them with an adhesive agent G in this way, it is needed to apply the adhesive agent G onto not only the back edge face PSa of the sheet bundle PS, but also the edge portions, adjacent to the back edge face PSa, of a pair of side surfaces (i.e., the front and back surfaces) of the sheet bundle PS. In the following description, the adhesive agent G that is applied onto the back edge face PSa is also referred to as a back glue and the adhesive agent G that is applied onto the above edge portions of the side surfaces is also referred to as a side glue. Moreover, the side glue that is applied onto the edge portion of a left side surface of the sheet bundle PS in the drawing is also referred to as a left side glue, and the side glue that is applied onto the edge portion of a right side surface of the sheet bundle PS is also referred to as a right side glue.

First, a user inputs printing information and bookbinding information by operating form information input keys provided on the operational input unit 19 of the printing apparatus 2. The printing information includes, inter alia, data of an image to be formed on each page of a booklet. Such data can be input by causing a reading device which is not depicted to read that data. The bookbinding information includes at least information regarding text sheets P2 and cover sheets P1 of a booklet, such as the size of the text sheets P2, the number of pages of a booklet, and the number of booklets to be finished by bookbinding. The printing information and bookbinding information may be received from a PC (personal computer) external to the printing apparatus 2.

After the user inputs necessary information as above by operating the operational input unit 19, pressing a start button not depicted initiates a printing operation and a bookbinding operation of the bookbinding system 1. After the printing apparatus 2 performs required printing and feeds printed cover sheets P1 and text sheets P2 to the bookbinding apparatus 3, the bookbinding operation is performed in the bookbinding apparatus 3. The following description, in particular, focuses on an operation in which the application roller 47 applies the adhesive agent G onto the back edge face PSa and the foregoing edge portions of a sheet bundle PS, that is, an operation of applying the back glue and the right and left side glues.

The bookbinding control unit 63 drives the clamper opening/closing motor MC to make the clampers 41A, 41B close, so that the clampers 41A, 41B hold a sheet bundle PS received from the aligner 33. The thickness sensor 71 detects a distance between the clampers 41A, 41B (that is, the thickness of the sheet bundle PS) and sends a thickness signal to the bookbinding control unit 63. The bookbinding control unit 63 receives the thickness signal sent from the thickness sensor 71, cognizes the thickness of the sheet bundle held by the clampers 41A, 41B, and controls an amount of rotation (rotation angle) of the application roller driving motor MR in an adhesive application process so that an amount of the adhesive agent G required for the sheet bundle PS with the cognized thickness can be applied onto the back edge face PSa. Furthermore, according to a given program, the bookbinding control unit 63 controls the clamper lateral motion motor MH1, the clamper back-forth motion motor MH2, and the clamper vertical motion motor MV appropriately for the cognized thickness of the sheet bundle PS and executes positioning the sheet bundle PS onto the application roller 47 and applying glue, as will be detailed below. That is, after the application roller 47 controlled by the bookbinding control unit 63 has applied side glues onto two edge portions of the side surfaces, the application roller 47 is made to contact two portions of the back edge face PSa which have been set appropriately according to the thickness information of the sheet bundle PS cognized by the thickness sensor 71 and rotate in a given direction for an adequate period of time (or by an adequate angle) to apply the back glue onto these portions.

Figure 4:
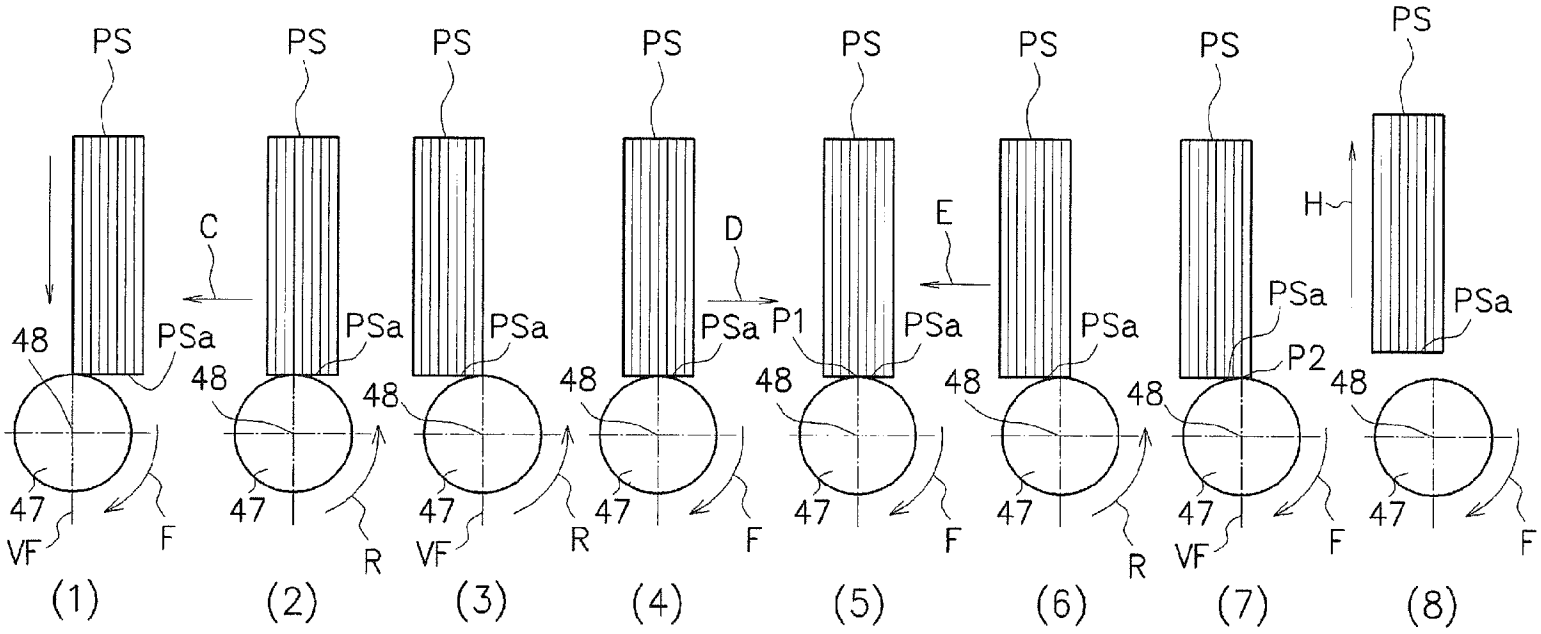
FIG. 4 are stepwise process diagrams representing a procedure for applying an adhesive agent onto the back edge face and its periphery of a bundle of text sheets with the application roller in the bookbinding apparatus pertinent to an embodiment of the present invention.

(1) First Step (FIG. 4(1), Applying the Left Side Glue)

Position the sheet bundle PS so that a vertical plane that defines the left side surface of the sheet bundle PS aligns with a vertical plane VF passing through the center of the rotary spindle 48 of the application roller 47. In this state, the bottom edge of the left side surface of the sheet bundle PS substantially aligns with the generatrix of the top of the application roller 47. In this state, rotate the application roller 47 in the forward direction F to apply the left side glue G onto the edge portion of the left side surface of the sheet bundle PS. Because only a smaller amount of the side glue G than the back glue G is required to be applied, only a relatively small amount of rotation (rotation angle) of the application roller 47 is required in the state of FIG. 4(1).

(2) Second Step (FIG. 4(2), Moving Left)

After the first step, stop the rotation of the application roller 47 and move the sheet bundle PS leftward as indicated by an arrow C with the sheet bundle PS remaining in contact with the application roller 47. The application roller 47 rotates in the reverse direction R along with the movement of the sheet bundle PS.

(3) Third Step (FIG. 4(3), Applying the Right Side Glue)

As the result of the second step, the sheet bundle PS is positioned such that its right side surface aligns with a vertical plane VF passing through the center of the rotary spindle 48 of the application roller 47. In this state, the bottom edge of the right side surface of the sheet bundle PS substantially aligns with the generatrix of the top of the application roller 47. In this state, rotate the application roller 47 in the reverse direction R to apply the right side glue G onto the edge portion of the right side surface of the sheet bundle PS. Because the application roller 47 rotates in the reverse direction R, the glue paring blade 70 does not function and it is unable to make a film of the glue G having a given thickness, adhered to the circumferential surface of the application roller 47. However, because only a small amount of the side glue G is required to be applied, as noted previously, even though the application roller 47 rotates in the reverse direction R, it is possible to apply an adequate amount of the right side glue G by rotating the application roller 47 only by an adequate rotation angle while maintaining the state of FIG. 4(3) in the same way as the step of applying the left side glue (FIG. 4(1)) in which the application roller 47 rotates in the forward direction F.

(4) Fourth Step (FIG. 4(4), Moving Right)

After the third step, stop the rotation of the application roller 47 and move the sheet bundle PS rightward as indicated by an arrow D with the sheet bundle PS remaining in contact with the application roller 47. The application roller 47 rotates in the forward direction F along with the movement of the sheet bundle PS.

(5) Fifth Step (FIG. 4(5), Applying the Back Glue for First Time)

As the result of the fourth step, the sheet bundle PS is positioned such that the generatrix of the top of the application roller 47 substantially aligns with a central position (which is denoted as a first position P1) of the back edge face PSa with respect to its thickness direction (horizontal direction in the drawing). In this state, rotate the application roller 47 in the forward direction F only by a given rotation angle. A layer of the glue G with a given thickness is formed on the circumferential surface of the rotating application roller 47 by the action of the glue paring blade 70. A given amount of the glue G is transferred into a gap between the back edge face PSa of the sheet bundle PS and the application roller 47 contacting the central position (first position P1) of the back edge face PSa in the thickness direction.

Figure 5:
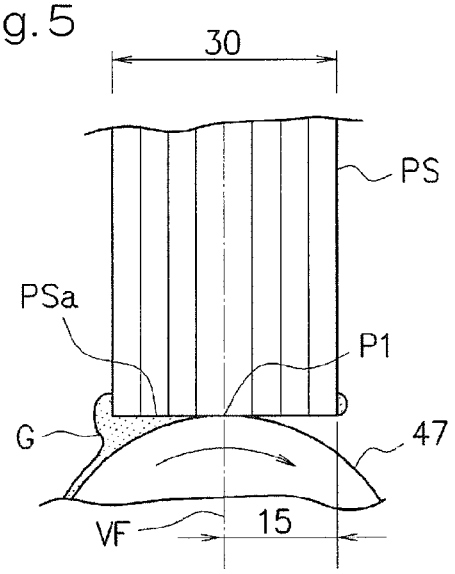
FIG. 5 is an enlarged front view representing one step of applying an adhesive agent onto the back edge face and its periphery of a bundle of text sheets with the application roller in the bookbinding apparatus pertinent to an embodiment of the present invention.

FIG. 5 is an enlarged view of the sheet bundle PS and the application roller 47 in the fifth step and represents a concrete example in which the sheet bundle PS has a thickness of 30 mm. The first position of the back edge face PSa with which the application roller 47 is in contact is a central position at 15 mm from the right and left sides respectively. The amount of rotation of the application roller 47 (the number of turns of the application roller 47 in central angles) is to be set appropriately depending on the thickness of the glue G adhering to the outer circumferential surface of the application roller 47 and the amount of the glue G to be applied to the back edge face PSa.

(6) Sixth Step (FIG. 4(6), Moving Left)

After the fifth step, stop the rotation of the application roller 47 and move the sheet bundle PS leftward as indicated by an arrow E with the sheet bundle PS remaining in contact with the application roller 47. The application roller 47 rotates in the reverse direction R along with the movement of the sheet bundle PS.

(7) Seventh Step (FIG. 4(7), Applying the Back Glue for Second Time)

As the result of the sixth step, the sheet bundle PS is positioned such that the vertical plane VF passing through the center of the rotary spindle 48 of the application roller 47 aligns with a second position P2 set between the first position P1 and the right side. In this state, rotate the application roller 47 in the forward direction F. A layer of the glue G with a given thickness is formed on the circumferential surface of the rotating application roller 47 by the action of the glue paring blade 70. A given amount of the glue G is transferred into a gap between the back edge face PSa of the sheet bundle PS and the application roller 47 contacting the second position P2 of the back edge face PSa.

Figure 6:
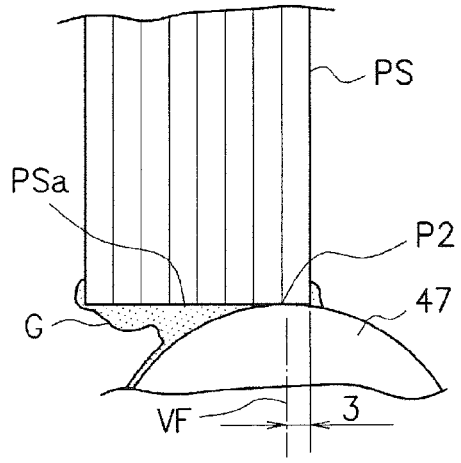
FIG. 6 is an enlarged front view representing one step of applying an adhesive agent onto the back edge face and its periphery of a bundle of text sheets with the application roller in the bookbinding apparatus pertinent to an embodiment of the present invention.

FIG. 6 is an enlarged view of the sheet bundle PS and the application roller 47 in the seventh step and represents the step executed later than depicted in FIG. 5 in the concrete example in which the sheet bundle PS has a thickness of 30 mm. In this concrete example, the second position P2 is set between the right side of the sheet bundle PS being forward with respect to the moving direction of the application roller 47 in the first position P1 and the first position P1 which is the center in the thickness direction. More specifically, this second position P2 is at 3 mm from the right side of the sheet bundle toward the first position P1 with respect to the thickness direction. The amount of rotation of the application roller 47 (the number of turns of the application roller 47 in central angles) is to be set appropriately depending on the thickness of the glue G adhering to the outer circumferential surface of the application roller 47 and the amount of the glue G to be applied to the back edge face PSa.

(8) Eighth Step (FIG. 4(8), Finishing Glue Application)

After the seventh step, move the sheet bundle PS vertically upward as indicated by an arrow H to detach the sheet bundle PS from the application roller 47. This finishes the glue application process.

Figure 7:
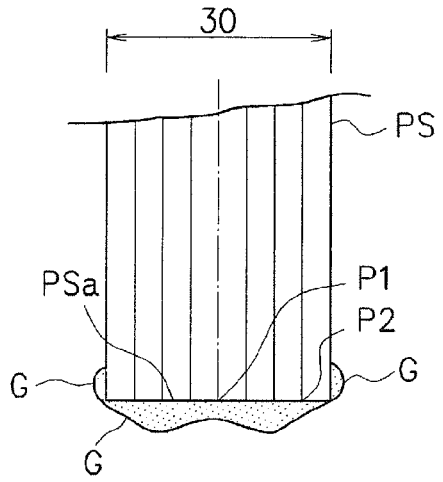
FIG. 7 is an enlarged front view representing the result of adhesive agent application onto the back edge face and its periphery of a bundle of text sheets with the application roller in the bookbinding apparatus pertinent to an embodiment of the present invention.

FIG. 7 is an enlarged view of the sheet bundle PS after the glue application process and represents the result of glue application through the steps depicted in FIGS. 5 and 6 in the concrete example in which the sheet bundle PS has a thickness of 30 mm.

As depicted in FIG. 7, according to the foregoing glue application process, only an adequate amount of right and left side glues G is applied onto the sheet bundle PS and an adequate amount of back glue G is applied onto its back edge face PSa with uniformity to such an extent that no trouble occurs in soft cover binding. According to FIG. 7, the back glue G applied for first time in the fifth step (FIG. 4(5) and FIG. 5) and the back glue G applied for second time in the seventh step (FIG. 4(7) and FIG. 6) are partially mixed together to form a layer on the back edge face PSa. This layer has slightly convex portions respectively on both sides of the first position P1 in the thickness direction. That is, the surface of the layer of the glue G applied onto the back edge face PSa is not exactly flat. However, the glue on the back edge face PSa in this degree of condition of application will be extended and its thickness will be generally uniform when a cover sheet is pressed against the back edge face PSa in soft cover binding, and it is possible to bond the cover sheet and the back edge face PSa positively.

When the back glue G has been applied twice onto the back edge face PSa with the application roller 47, two convexes of the glue G are formed on the back edge face PSa. If there is a large level difference between these two convexes and a recess between the two convexes, it is supposable that the two convexes of the glue G sag and drop by gravity and the amount of the glue G that is applied onto the back edge face PSa becomes insufficient. But there is no fear of this occurring because the level difference between the convexes and the recess is small, according to this application process. If two extreme convexes as noted above are formed, the amount of glue in the recess portion is less and it is thus supposable that, in the recess portion, bonding becomes insufficient due to an insufficient amount of glue when a cover sheet is bonded to the back edge face PSa in soft cover binding. But there is no fear of this occurring because a sufficient amount of glue is ensured also in the recess portion, according to this application process.

Figure 8:
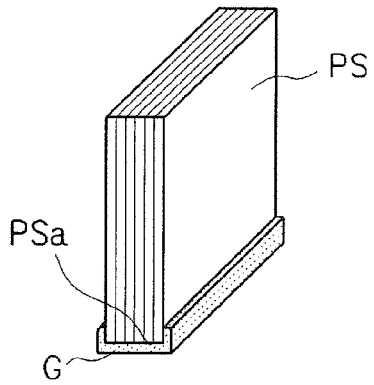
FIG. 8 is a perspective view representing a state in which the adhesive agent has been applied appropriately onto the back edge face and its periphery of a bundle of text sheets in an embodiment of the present invention.
Figure 9:
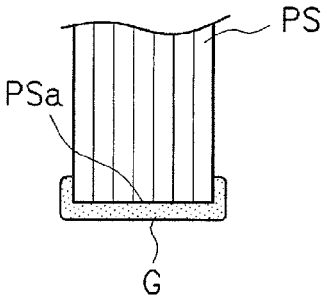
FIG. 9 is an enlarged front view in the vicinity of the back edge face, representing the state in which the adhesive agent has been applied appropriately onto the back edge face and its periphery of a bundle of text sheets in an embodiment of the present invention.
Figure 10A:
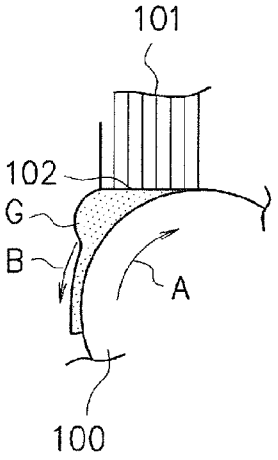
FIGS. 10A to 10C are enlarged front views representing how glue behaves when an adhesive agent is applied onto the back edge face and its periphery of a bundle of text sheets with the application roller and the application result in a bookbinding apparatus of related art.
Figure 10B:
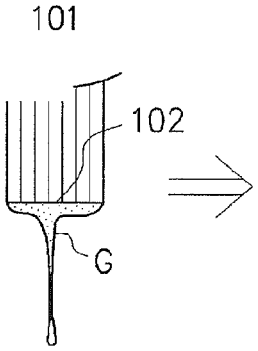
Figure 10C:
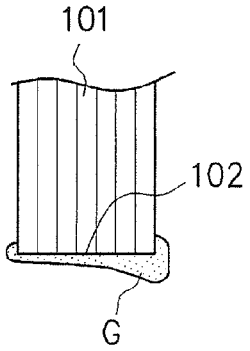

FIG. 8 is a perspective view representing a state in which the adhesive agent G has been applied the most appropriately onto the back edge face PSa and its periphery of a bundle of text sheets PS in an embodiment of the present invention. FIG. 9 is an enlarged front view in the vicinity of the back edge face PSa, representing the same state. In the way as above, by setting the amounts of side glue G and back glue G to be applied appropriately for the thickness of the back edge face PSa of the sheet bundle PS, setting back glue G application positions on the back edge face PSa after applying the side glues G, and rotating the application roller 47 in the forward direction F and applying the back glue G in order of the first position P1 and the second position P2, it is possible to make the amounts of right and left side glues G constant and apply the back glue G as well that is substantially as uniform in thickness as the side glue G, as depicted in these figures.

Next, descriptions are provided about conditions or the like for applying an adequate amount of back glue evenly onto the back edge face of a sheet bundle with the application roller in adhesive binding including soft cover binding in an embodiment of the present invention.

To apply back glue evenly onto the back edge face of a sheet bundle to such an extent that no trouble occurs in bonding a cover sheet to the back edge face, although not forming an exactly flat layer of the glue, findings which will be described subsequently, known by the present inventors through experiment, are useful. The application method described with reference to FIG. 4 in the present embodiment and described with a concrete example of sheet bundle thickness in FIGS. 5 through 7 is a concrete example based on these findings. According to these findings, the amount of the glue G to be applied onto the back edge face PSa needs to be set depending on the thickness of a sheet bundle PS. Then, application of the glue G onto the back edge face PSa is performed twice in separate steps. A total required amount of the glue G needs to be separated and applied in two positions of the back edge face PSa.

First, a description is provided about the amount of the glue G to be applied onto the back edge face PSa. The glue G to be applied onto the back edge face PSa is proportional to the thickness of a sheet bundle PS; the thicker the sheet bundle PS, the more of glue is needed. As noted in the description of the embodiment, the amount of glue that is applied is proportional to the rotation angle when the application roller is rotated, while being in contact with the back edge face PSa.

Assuming that the thickness of the sheet bundle PS has been given and the amount of glue that is applied onto its back edge face PSa has been determined, a description is then provided about how to set two positions that are the most appropriate for applying that amount of the glue G onto the back edge face PSa and the rotation direction of the application roller 47. When glue application is performed twice, application of the back glue G for a first time is performed as follows: bring the application roller 47 in contact with the back edge face PSa in the first position P1 being within a central region of the back edge face PSa in its thickness direction; and rotate the application roller 47 in the forward direction F. Application of the back glue G for a second time is performed as follows: set the second position P2 between the first position P1 and one side (right side in the example depicted) of the sheet bundle PS being forward with respect to the moving direction of the application roller 47 in the first position P1; and bring the application roller 47 in contact with the back edge face PSa in the second position P2 and rotate it in the forward direction F.

The reason for this is as follow. By bringing the application roller 47 in contact with a point (first position P1) near the central position of the back edge face PSa, rotating the roller in the forward direction F, and applying the glue G, the glue G can be supplied to the face backward of the central position with respect to the rotation direction of the application roller 47. Then, by moving the application roller 47 to the second position P2 being forward in the rotation direction of the application roller 47 relative to the central position, rotating the roller in the forward direction F again, and supplying the glue G, the remaining required amount of the glue G can be supplied to the face forward of the central position with respect to the rotation direction of the application roller 47, without acting to remove the glue applied for the first time from the back edge face PSa.

In this way, two positions in which the glue G is applied with the application roller 47 are set so that the glue G is applied separately on both sides of the substantially central position of the back edge face PSa. Furthermore, as described previously, the rotation angle of the application roller 47 in each position is set so that the amount of glue appropriate for the thickness of the sheet bundle PS can be supplied totally. By doing so, it is possible to apply an adequate amount of the glue G in two positions of the back edge face PSa at an appropriate interval and it is achievable to apply an adequate amount of the glue evenly to such an extent that no trouble occurs in soft cover binding.

In the concrete example described with reference to FIGS. 5 through 7 in the present embodiment, the thickness of the sheet bundle PS is 30 mm. However, for a sheet bundle with a thickness of, roughly, at least 20 mm and less than 40 mm, favorable application can be performed, provided that the first position P1 in which the application roller 47 should contact the back edge face PSa is set at the center in the thickness direction and the second position P2 is set at 3 mm from the right side of the sheet bundle or very close to 3 mm as depicted in the drawing.

In the example in which the sheet bundle is 30 mm thick, as depicted in FIGS. 5 through 7, the second position P2 is set at 3 mm from the right side of the sheet bundle and 12 mm from the first position P1 (central position). In another case, if the sheet bundle is 20 mm thick, the second position P2 is set at 3 mm from the right side of the sheet bundle, which is the same as for the 30 mm thick sheet bundle, but its distance from the first position P1 (central position) becomes 7 mm because of a decrease of 10 mm in the thickness. According to this position setting, even in the case in which the sheet bundle is 20 mm thick, a favorable result can be obtained as is the case for the 30 mm thick sheet bundle. In this way, a favorable result can be obtained by similar position setting for a sheet bundle with a thickness of at least 20 mm and less than 40 mm.

Although the first position P1 is preferably set at a position as close as possible to the center of the back edge face PSa in the thickness direction, it may be within a central region of the back edge face PSa, which has been set in the thickness direction. According to the findings obtained by the present inventors through experiment, it is preferable that the central region within which the first position P1 should be set falls within a range of 20% or less of the thickness of the sheet bundle, including the central position of the back edge face PSa in the thickness direction, in order to obtain a favorable result of glue application as above.

In the example described hereinbefore, the thickness of the sheet bundle PS is limited to less than 40 mm and the number of positions in which the application roller 47 should contact the back edge face PSa is two. However, if the thickness of the sheet bundle PS becomes 40 mm or more, the required amount of glue G and the glue application area increase. Accordingly, three positions or more need to be set as the positions in which the application roller 47 should be brought in contact with the back edge face PSa of the sheet bundle PS to apply glue G. Position setting in such a case is discussed based on FIGS. 5 through 7, taking an example in which the sheet bundle PS is 40 mm thick. On the back edge face PSa depicted in the drawing, a position at 3 mm from the right side of the sheet bundle is set as a third position P3 in which glue is applied for a third time. Then, the edge face between this third position and the left side of the sheet bundle is divided into three sections by two dividing points (with an interval of about 12.3 mm). A dividing point nearer to the left side is set as a first position P1 in which glue is applied for first time and another dividing point is set as a second position P2 in which glue is applied for second time. Preferably, an amount of rotation (rotation angle) of the application roller 47 to be rotated in the forward direction F in each position is set equal so that a total amount of glue required for 40 mm of the thickness of the sheet bundle PS can be obtained. By doing as above, it is possible to form a uniform layer of glue on the back edge face as is the case for a sheet bundle with a thickness of at least 20 mm and less than 40 mm.

As for a thin sheet bundle that is less than 20 mm thick, it can be handled by applying glue twice in the same manner as for a sheet bundle with a thickness of, roughly, at least 20 mm and less than 40 mm, or glue application can also be performed favorably by applying glue only in one position that corresponds to the second position.

As described hereinbefore, according to the embodiment of the present invention, the back glue G is applied by bringing the application roller 47 in contact with the first position P1 in the central region on the back edge face PSa of a sheet bundle PS and rotating the roller in the forward direction F. Then, the back glue G is applied for a second time by moving the application roller 47 in such a direction that the applied back glue G is not be peeled off and rotating the application roller 47 in the forward direction F at the second position P2. As a whole, a required amount of the back glue G appropriate for the thickness of the sheet bundle PS can be applied onto the back edge face PSa. Consequently, the thus formed layer of the back glue G does not have a thick portion in which some of glue drops and the amount of glue becomes insufficient and a portion in which glue has been applied unevenly, causing insufficient bonding. Even though there are slightly concave and convex portions, the concave and convex portions of the adhesive agent G applied onto the back edge face PSa are leveled in binding to make a flat layer of the adhesive agent G with an adequate thickness. Thus, troubles such as spine split and loose sheets are less liable to occur in a finished book.

According to the embodiment of the present invention, the application of the forgoing back glue G is performed after the application of right and left side glues G. Conversely, if an adhesive agent G is applied to the side surfaces of a sheet bundle PS after the application of the adhesive agent G onto the back edge face PSa of the sheet bundle PS, a case is supportable where the adhesive agent adhered to the back edge face PSa may be peeled off depending on which direction in which the application roller 47 rotates. As a result, it may be impossible to apply the adhesive agent G to the side surfaces of the sheet bundle PS, when doing so, because there is no adhesive agent G adhering to the circumferential surface of the application roller 47. According to the embodiment of the present invention, free from such disadvantage, it is possible to positively apply an adhesive agent G required to perform soft cover binding that laps the sheet bundle with a cover sheet, bonding the cover sheet to the back edge face PSa initially.

In the embodiment described hereinbefore, the clampers 41A, 41B are provided with the thickness sensor 71 to detect the thickness of a sheet bundle PS, so that the amount of glue to be applied onto the back edge face PSa is determined depending on the thickness of the sheet bundle PS. However, the thickness of a sheet bundle PS given by information regarding the thickness may be used, if this information is included in bookbinding data that is input. If not, the thickness may be calculated from the number of pages, the paper quality of sheets that are used, etc. in the bookbinding data that is input and put in use.

Furthermore, in the embodiment described hereinbefore, positioning the application roller 47 onto the back edge face PSa of a sheet bundle PS is done by moving the clampers 41A, 41B clamping the sheet bundle PS with the application roller 47 fixed in place. However, this positioning may be done by moving the application roller 47 with the clampers 41A, 41B clamping the sheet bundle PS fixed in place, which can produce the same effect.

The invention claimed is:

1. A bookbinding apparatus comprising:

A holding element that holds a bundle of text sheets into which a plurality of text sheets have been gathered with a back edge face of the bundle down by nipping at two side surfaces;

an application roller that rotates, while being partially immersed in an adhesive agent, on a rotary shaft which is parallel with a top-bottom direction of the bundle of text sheets held by the holding element;

a motive mechanism including a motive element for making a relative motion between the holding element and the application roller; and a control unit that controls the holding element, the application roller, and the motive mechanism in such a way as to bring the application roller in contact with the back edge face of the bundle in a plurality of positions, respectively, which have been set on the back edge face along a thickness direction perpendicular to the top-bottom direction of the bundle of text sheets, rotate the application roller in each of the positions, and apply the adhesive agent onto the back edge face of the bundle, wherein the control unit controls rotation of the application roller and the motive mechanism in such a way as to bring the application roller in contact with the back edge face of the bundle at a first position within a given central region set on the back edge face with respect to the thickness direction, rotate the application roller in a given first direction, and apply the adhesive agent onto the back edge face of the bundle; and in such a way that, after stopping the rotation of the application roller, while contacting the application roller and the back edge face of the bundle, the holding element and the application roller are relatively moved to bring the application roller in contact with the back edge face of the bundle at a second position set on the back edge face with respect to the thickness direction and rotate the application roller in the given first direction.

2. The bookbinding apparatus according to claim 1, wherein the control unit controls the application roller and the motive mechanism in such a way to execute application of the adhesive agent onto the back edge face of the bundle after applying the adhesive agent onto a portion of the both side surfaces along the back edge face respectively with the application roller.

* * * * *